US005229260A

United States Patent [19]

Takamuki et al.

[11] Patent Number: 5,229,260

[45] Date of Patent: Jul. 20, 1993

[54] SILVER HALIDE PHOTOGRAPHIC LIGHT SENSITIVE MATERIAL

[75] Inventors: Yasuhiko Takamuki; Hiroshi Nakamura, both of Hino, Japan

[73] Assignee: Konica Corporation, Tokyo, Japan

[21] Appl. No.: 848,299

[22] Filed: Mar. 9, 1992

[30] Foreign Application Priority Data

Mar. 13, 1991 [JP] Japan ..... 3-48341

[51] Int. Cl.[5] ..... G03C 1/85

[52] U.S. Cl. ..... 430/527; 430/523; 430/533; 430/621; 430/623

[58] Field of Search ..... 430/523, 527, 533, 623, 430/621, 529

[56] References Cited

U.S. PATENT DOCUMENTS

| | | | |
|---|---|---|---|
| 3,535,147 | 10/1970 | White | 430/533 |
| 4,828,974 | 5/1989 | Okamura et al. | 430/623 |
| 4,914,018 | 4/1990 | Besio et al. | 430/527 |
| 5,034,249 | 7/1991 | Reif et al. | 430/623 |
| 5,079,136 | 1/1992 | Tachibana et al. | 430/523 |
| 5,102,780 | 4/1992 | Terashima et al. | 430/523 |

*Primary Examiner*—Jack P. Brammer

*Attorney, Agent, or Firm*—Frishauf, Holtz, Goodman & Woodward

[57] ABSTRACT

A photographic material comprising a light sensitive silver halide emulsion layer and an antistatic layer is disclosed., wherein at least one of the hydrophilic colloidal layers is hardened by a hardener represented by a formula of

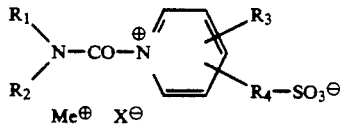

wherein $R_1$ and $R_2$ represent each an alkyl group having 1 to 3 carbon atoms, an aryl group or an aralkyl group, provided, they may be the same with or the different from each other and they may so associate together as to represent 'an atom group necessary to form a piperidine ring or a morpholine ring' in which the piperidine ring or the morpholine ring may each be substituted with an alkyl group or a halogen atom; $R_3$ represents a hydrogen atom, a methyl group or an ethyl group; $R_4$ represents a methylene group, a propylene group or a simple chemical bond; $Me^+$ represents an alkali-metal cation; and $X^-$ represents an anion. The photographic material has preferable antistatic property and is suitable for the use of lithographic film.

12 Claims, No Drawings

SILVER HALIDE PHOTOGRAPHIC LIGHT SENSITIVE MATERIAL

FIELD OF THE INVENTION

This invention relates to a silver halide photographic light sensitive material excellent in electric charge preventing function and, particularly, to a silver halide photographic light sensitive material for printing plate making use.

BACKGROUND OF THE INVENTION

Generally, a plastic film is high in electric chargeability. Therefore, there have been many instances where many application of the plastic films have been substantially limited. In silver halide photographic light sensitive materials, for example, a support such as one made of polyethylene terephthalate has commonly been used, however, this type of silver halide photographic light sensitive materials is liable to be electrically charged particularly at substantially low humidity such as in winter time. When a high-speed photographic emulsion is coated at a high speed or when a high-speed light sensitive material is exposed to light and processed through an automatic processor as in recent times, it has become particularly essential to take measures to prevent electric-charge build-up.

When a light sensitive material is electrically charged, an electrostatic mark may be caused by discharge of the resulting electric charge or foreign matter such as dust may adhere to the light sensitive material. Thereby a pin-hole may be produced so that the quality of the light sensitive material may be deteriorated and the operability of handling the light sensitive material is seriously lowered when remedying the above-mentioned disadvantages. Therefore, an antistatic agent has commonly been applied to a light sensitive material and, recently, a fluorine-containing surfactant, a cationic surfactant, an amphoteric surfactant, a surfactant or a high-molecular compound containing a polyethylene oxide group, and a polymer containing a sulfonic acid group or a phosphoric acid group in the molecules thereof have been applied thereto.

Particularly, fluorine type surfactants have been mostly used for controlling electrification degree or electroconductive polymers have also been mostly used for improving electroconductivity. For example, JP OPI Publication Nos. 49-91165/1974 and 49-121523/1974 disclose the examples in which the ion-type polymers each having a disassociating group in the principal chains of the polymers.

In the above-mentioned conventional techniques, however, the antistatic function seriously deteriorates as a result of the development process. It is assumed that the deterioration of the antistatic function is caused in the course of carrying out a developing step in which an alkali is used, an acidic fixing step and a step such as a washing step. Accordingly, as in printing plate-making light sensitive materials, when a print is made by further making use of a processed film, there raises a problem such as a pin-hole produced by dust adhesion thereto. Therefore, JP OPI Publication Nos. 55-84658/1980 and 61-174542/1986, for example, each propose the antistatic layers comprising a water-soluble electroconductive polymer containing a carboxyl group, a hydrophobic polymer containing a carboxyl group and a polyfunctional aziridine. According to these techniques, an antistatic function may be retained even after completing a process, however, a light sensitivity may be lowered by allowing to stand and a residual color of the dyes contained in a backing layer may be noticeable. Therefore, it has been demanded to develop a silver halide photographic light sensitive material excellent in antistatic property without producing any light sensitivity lowering even in allowing to stand and not reserving noticeable residual colors.

SUMMARY OF THE INVENTION

Upon taking the above-mentioned problems into consideration, it is an object of the invention to provide a silver halide photographic light sensitive material excellent in antistatic property without producing any light sensitivity lowering even in allowing to stand and not reserving noticeable residual colors.

Each of the silver halide photographic light sensitive materials of the invention is comprised of a polyester-made support having thereon at least one of hydrophilic colloidal layers out of which at least one of them is a light sensitive silver halide emulsion layer and an antistatic layer, and at least one of the hydrophilic colloidal layers is hardened by a hardener represented by Formula I.

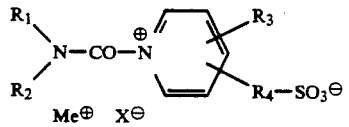

Formula I wherein $R_1$ and $R_2$ represent each an alkyl group having 1 to 3 carbon atoms, an aryl group or an aralkyl group, provided, they may be the same with or the different from each other and they may so associate together as to represent 'an atom group necessary to form a piperidine ring or a morpholine ring' in which the piperidine ring or the morpholine ring may each be substituted with an alkyl group or a halogen atom; $R_3$ represents a hydrogen atom, a methyl group or an ethyl group; $R_4$ represents a methylene group, a propylene group or a simple chemical bond; $Me^+$ represents an alkali-metal cation; and $X^-$ represents an anion.

In the hydrophilic colloidal layers coated over the above-mentioned polyester-made support, the whole amount of the gelatin contained therein is desirable to be not more than 2.5 g/m$^2$ on each side of the support.

DETAILED DESCRIPTION OF THE INVENTION

In Formula I, $R_1$ and $R_2$ represent each an alkyl group having 1 to 3 carbon atoms, an aryl group (which may be substituted with a lower alkyl group or a halogen atom and includes, for example, a phenyl group which may further be substituted with a methyl group, an ethyl group, a chlorine atom or a bromine atom), an aralkyl group (which includes, for example, a benzyl group and may be substituted with the same substituents an in the above-given aryl groups), provided, $R_1$ and $R_2$ may represent 'an atom group necessary to form a piperidine ring or a morpholine ring' when $R_1$ and $R_2$ are bonded to each other, and the piperidine ring or the morpholine ring may be substituted with an alkyl group (such as a methyl or ethyl group) or a halogen atom (such as those of chlorine and bromine);

$R_3$ represents a hydrogen atom, a methyl group or an ethyl group;

$R_4$ represents a methylene group, a propylene group or a simple chemical bond; and $Me^+$ represents an alkali-metal cation (such as $Li^+$, $Na^+$ and $K^+$); and $X^-$ represents an anion (such as $Cl^-$ and $Br^-$).

The hardener compounds of the invention represented by formula I include, typically, the following compounds. And, among the compounds 1 through 17 given in JP OPI Publication No. 51-59625/1976, pp. (3)–(4), the compounds other than the following compounds may also be included.

I-1

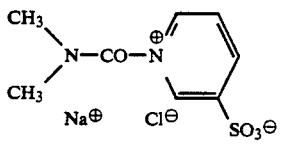

I-2

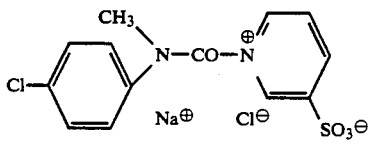

I-3

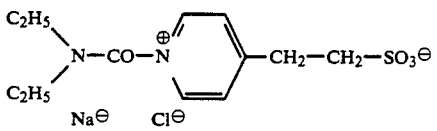

I-4

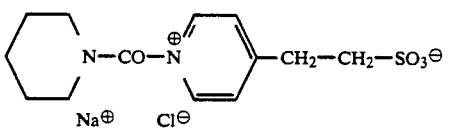

I-5

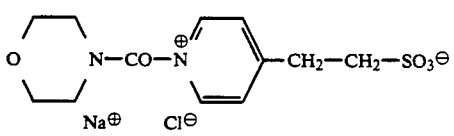

I-6

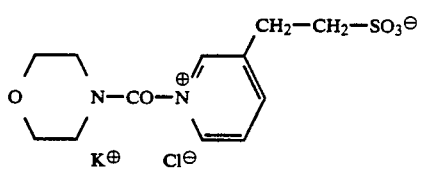

Next, the antistatic layer will be detailed below.

In the invention, the antistatic layers include, preferably,

[A] a layer containing (1) a water-soluble electroconductive polymer, (2) a hydrophobic polymer latex and (3) a hardener reactant, or [B] a layer containing a metal oxide.

The water-soluble electroconductive polymers include, for example, a polymer containing at least one electroconductive group, which is selected from the group consisting of a sulfonic acid group, a sulfuric acid ester group, a quaternary ammonium salt, a tertiary ammonium salt and a carboxyl group. The water-soluble electroconductive polymers may contain a hydroxy group, an amino group, an epoxy group, an aziridine group, an active methylene group, a sulfinic acid group, an aldehyde group and/or a vinylsulfone group.

The number average molecular weight of each of the polymers is within the range of 3000 to 100000 and, preferably, 3500 to 50000.

The examples of the water-soluble electroconductive polymers include A-1 through A-21 given in JP Application No. 2-146629/1990, pp. 6 to 11 and, the typical examples thereof will be given below as P-1 to P-10.

P-1

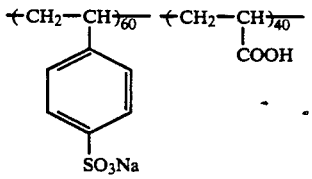

$\overline{Mn}$ = 7000

P-2

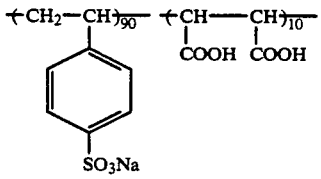

$\overline{Mn}$ = 5000

P-3

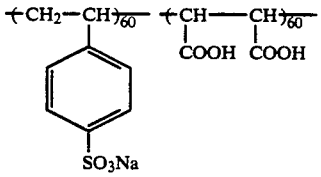

$\overline{Mn}$ = 5000

P-4

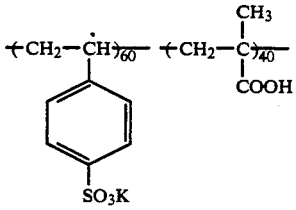

$\overline{Mn}$ = 8000

P-5

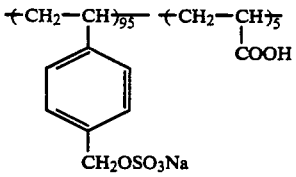

$\overline{Mn} \approx 25000$

P-6

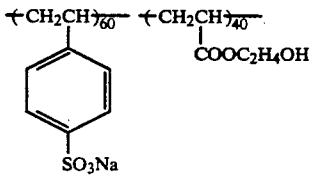

x:y = 90:10

$\overline{Mn}$ = 7000

-continued

P-7

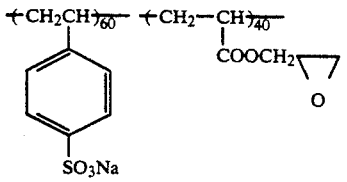

$\overline{Mn}$ = 5000

P-8

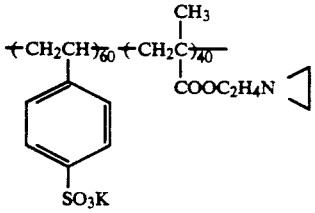

$\overline{Mn}$ = 8000

P-9

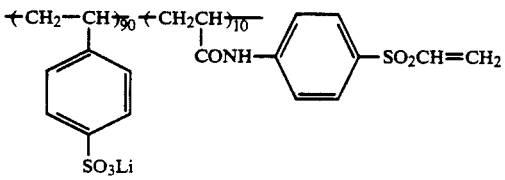

$\overline{Mn}$ ≈ 6000

-continued

P-10

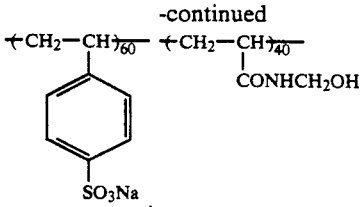

$\overline{Mn}$ ≈ 10000

In the above-given examples P-1 through P-10, Mn represents an average molecular weight, (provided, it indicates a number average molecular weight in this specification), and it is expressed in terms of the measured value obtained by GPC converted into a polyethylene glycol unit.

A hydrophobic polymer latex, which is contained in a water-soluble electroconductive polymer layer that is an example of the foregoing antistatic layers, is comprised of the so-called latex substantially incapable of being dissolved in water. The above-mentioned hydrophobic polymers can each be prepared by polymerizing the monomers selected from the group consisting of any desired combinations of styrene, a styrene derivative, alkyl acrylate, alkyl methacrylate, an olefin derivative, a halogenated ethylene derivative, a vinyl ester derivative and acrylonitrile. In particular, the hydrophobic polymers are desirable to contain a styrene derivative, alkyl acrylate and alkylmethacrylate each in a proportion of at least 30 mole % and, preferably, not less than 50 mol %.

The concrete examples of these hydrophobic polymer latexes include L-1 through L-26 given in JP Application No. 2-146629/1990, pp. 13 to 19. Among them, the typical examples thereof will be given below.

L-1

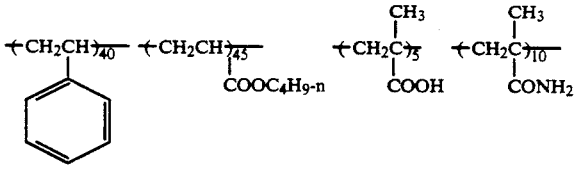

L-2

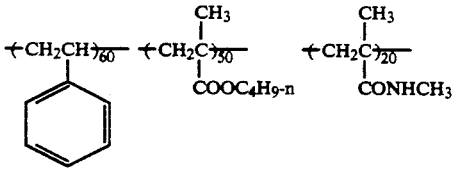

L-3

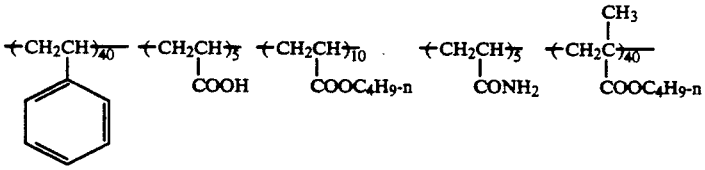

L-4

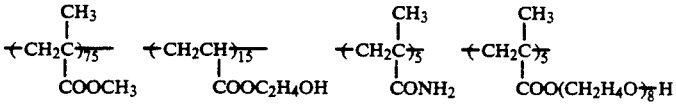

-continued

L-5

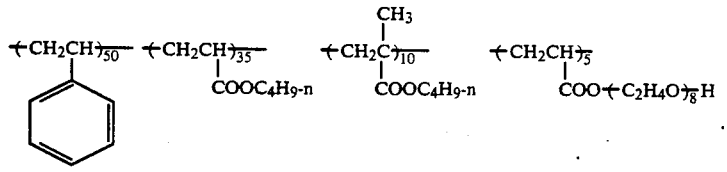

L-6

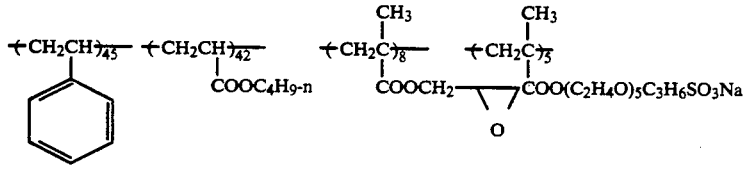

L-7

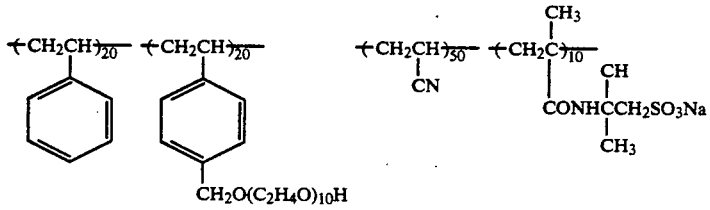

L-8

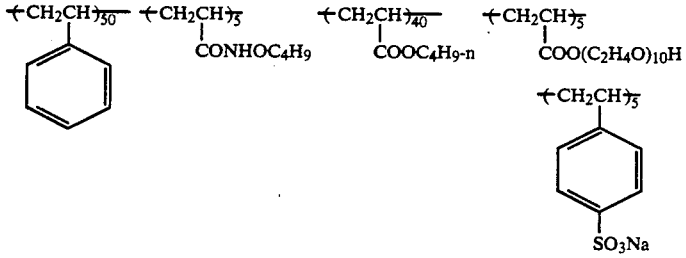

L-9

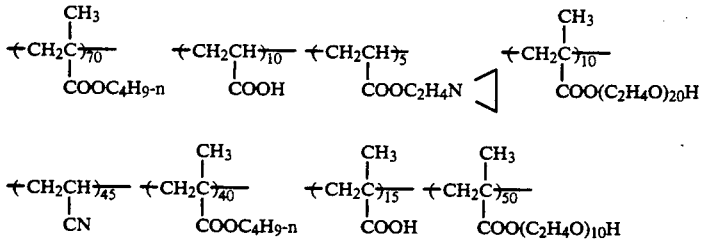

In the invention, it is also allowed to use other hardeners in preparation of the antistatic layer of the invention such as an epoxy type, aldehyde type, vinyl sulfone and aziridine type hardener in preparation of the antistatic layer of the invention. Of these the epoxy type hardener is preferably used. It is further allowed to make combination use of a plurality of hardeners.

The hardener is allowed to be added to at least one of hydrophilic colloidal layer, an example of which is a silver halide emulsion layer or a backing layer. An amount of the hardener is 10 to 1,000 mg, preferably 50 to 500 mg per 1 g of gelatin at each side.

The preferable epoxy hardeners include, for example, those containing a hydroxy group or an ether condensate besides an epoxy group.

Each of the epoxy equivalents is to be within the range of, desirably, 50 to 300 and, preferably, 80 to 210. When exceeding not less than 300, the hardening degrees are low and when increasing it, the coating property is deteriorated. When the hardening degrees are low, a scratch is liable to produce. When an epoxy equivalent is not more than 50, a haze and a residual-color characteristics are deteriorated, though the hardening degrees are relatively high. In this instance, these deteriorations cannot be remedied even if increasing the epoxy equivalents.

The epoxy equivalents are described in, for example, 'The Course of New Experimental Chemistry' Series 13(1), Organic Structure, p.58, Maruzen Co. and the quantitative colorimetric analysis can be performed in the method described therein.

The concrete examples of the epoxy compounds include E-1 through E-11 given in JP Application No. 2-146629/1990 and the typical examples thereof will be given below.

In the following examples, the figures shown in the parentheses indicate each an epoxy equivalent.

-continued

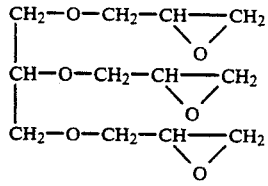

E-1

(102)

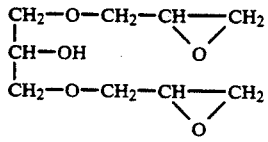

E-2

(101.5)

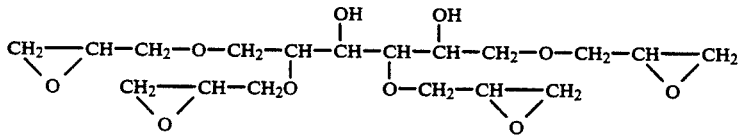

E-3

(148)

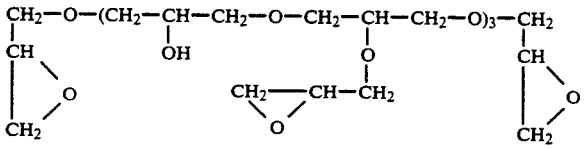

E-4

(109)

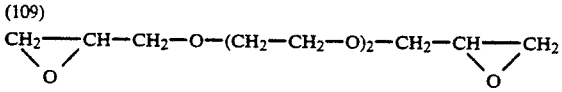

E-5

(196)

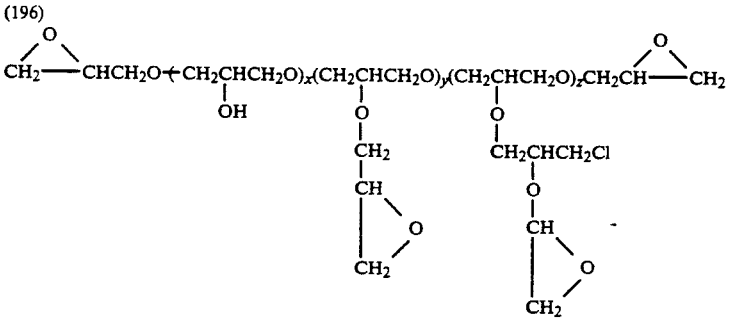

E-6 x = 5
y = 1
z = 5

(329)

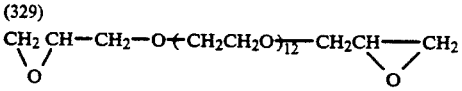

E-7

Such an epoxy hardener is to be preferably added in an amount within the range of 5 mg/m$^2$ to 1 g/m$^2$.

The epoxy hardeners may be applied to any one of an antistatic layer, a sublayer, an emulsion layer, a backing layer and a protective layer. Among these layers, the antistatic layer or a hydrophilic colloidal layer arranged to the side where the antistatic layer is arranged.

Next, in the case where an antistatic layer contains a metal oxide, the metal oxides applicable thereto include any one of the metal oxides doped therein with indium oxide, tin oxide or antimony atom or the combinations thereof. The fine particles of these metal oxides are dispersed in a binder such as gelatin and the resulting dispersion is coated over a light sensitive material.

As for the indium oxides, indious oxide ($In_2O$) and indic oxide ($In_2O_3$) are known. In the invention, indic oxide is preferably used.

As for the tin oxides, stannous oxide (SnO) and stannic oxide ($SnO_2$) are known. In the invention stannic oxide is preferably used.

The metal oxides each doped therein with an antimony atom include, typically, tin oxide and iridium oxide. The above-mentioned metal oxides may be doped with an antimony atom by oxidatively sintering a mixture of the halide, alkoxy compound or nitrate compound of tin or indium , the halide or nitrate compound of antimony and the halide, alkoxy compound or nitrate compound of antimony. These metal oxide compounds are readily available from such a metal compound manufacturer as Japan Yttrium Co. When doping antimony in a metal oxide, the antimony content is preferably within the range of 0.5 to 10% by weight to tin or indium used. These inorganic compounds are preferable to be added by dispersing them in a hydrophilic colloid such as gelatin or by dispersing them in a high molecular compound such as acrylic acid and maleic acid. The proportion of carrying them is preferable to be within the range of 1 to 100% by weight per a binder used.

In an antistatic layer of the invention, the pH of the layer surface is preferable to be not higher than 8.0. It is not preferable from the viewpoint of the layer stability when the pH of the layer surface is too low. Therefore, the preferable pH thereof is to be within the range of 3.0 to 7.5.

The antistatic layers of the invention may be arranged to the support side with respect to a light sensitive layer or may be arranged to the so-called back side, that is the side opposite to the support side with respect to the light sensitive layer.

In the invention, an antistatic layer is coated over a transparent support. Any one of the transparent supports for photographic use may be used therein. It is, however, preferable to use a polyethylene terephthalate or cellulose triacetate supports so prepared as to transmit not less than 90% of visible rays of light.

These transparent supports are prepared in the methods well-known by the person skilled in the art. However, according to circumstances, these transparent supports are also allowed to be blue-tinted by adding some dyes so as not to substantially interfere a light transmission.

According to the invention, both sides of a polyester support are coated each with at least one hydrophilic colloidal layer containing gelatine. Among the colloidal layers, at least one of the layers is a silver halide emulsion layer. The amount of gelatin of the hydrophilic colloidal layers include the whole gelatin used in each side of the support. When the aggregate amount of the gelatin on each side is not more than 2.5 g/m$^2$, a particularly preferable effect can be enjoyed.

The supports of the invention are each allowed to be coated with a sublayer containing a latex polymer after they are subjected to a corona-discharge treatment. In the corona-discharge treatment, an energy of 1 mW to 1 KW/(m$^2$.min) is particularly preferable to be applied. It is also particularly preferable to carry out another corona-discharge treatment again at any point of time between the time after coating a latex sublayer and the time before coating an antistatic layer.

The silver halides of the invention contain each at least 50 mol % of silver chloride in the form of silver chloride, silver chlorobromide or silver chloroiodobromide having any desired composition. The silver halide grains applicable thereto have an average grain size within the range of 0.025 to 0.5 μm and, preferably, 0.05 to 0.30 μm.

Such grains as mentioned above may be prepared in any one of an acidic method, a neutral method and an ammoniacal method. They may have any desired configurations such as a cube, an octahedron, a tetradecahedron, a dodecahedron and a tabular-shape.

The silver halides of the invention may be or may not be subjected to various types of the sensitizing methods having been known in the industry of photographic light sensitive materials. When they are chemically sensitized, a sulfur sensitization method, a reduction sensitization method or a noble-metal sensitization method may be carried out independently or in combination. Besides the above, a variety of sensitizers, sensitizing dyes and additives which have been known in the photographic industry may also be used therein. When they are used for making printing-plates, it is preferred to add at least one kind of tetrazolium compounds and hydrazine compounds having been known as the so-called contrast-hardeners.

It is allowed to use a variety of the processing solutions such as a developer and a fixer and the processing equipments, which have commonly been used in the photographic industry.

Example 1

(Coating of an antistatic layer)

(1) Polymer antistatic layer (Pc)

After a corona-discharge treatment was applied at an intensity of 10W/(m$^2$.min), another corona-discharge treatment was applied at an intensity of 10W/(m$^2$.min) onto a polyethylene terephthalate support subbed with vinylidene chloride and an antistatic layer having the following composition was then coated thereon.

| | |
|---|---|
| Water-soluble electroconductive polymer (P-3) | 0.7 g/m$^2$ |
| Hydrophobic latex (L-3) | 0.2 g/m$^2$ |
| Ammonium sulfate | 20 mg/m$^2$ |
| Hardener (E-6) | 0.1 g/m$^2$ |
| Polyethylene glycol (having a molecular weight of 600) | 5 mg/m$^2$ |

(2) Metal oxide antistatic layer (M)

A metal oxide antistatic layer having the following composition was coated in the same manner as in the above-mentioned polymer antistatic layer.

| | |
|---|---|
| Gelatin | 0.2 g/m$^2$ |
| A styrene-maleic acid copolymer | 50 mg/m$^2$ |
| Polyethylene glycol | 2 mg/m$^2$ |
| Metal oxide (doped with tin oxide-antimony) | 0.1 g/m$^2$ |
| Hardener (E-2) | 50 mg/m$^2$ |

(Preparation of emulsions)

A silver chlorobromide emulsion having a silver bromide content of 2 mol % was prepared in the following manner.

An aqueous silver nitrate solution and a gelatin solution containing sodium hexabromorhodium, sodium chloride and potassium bromide of 20 mg per 60 g of silver nitrate were mixed up and stirred in a double-jet method at 40° C. for 25 minutes, so that a silver chlorobromide emulsion having an average grain size of 0.2 μm was prepared.

To the resulting emulsion, 190 mg of 5-methyl-4-hydroxy-1,3,3a,7-tetrazaindene was added and the resulting mixture was then washed and desalted in ordinary methods.

After adding 20 mg of 6-methyl-4-hydroxy-1,3,3a,7-tetrazaindene thereto, a sulfur sensitization treatment was carried out and, then, an emulsion was prepared by adding water to make 300 ml.

(Coating of a silver halide emulsion layer)

The following additives were added to the resulting emulsion with adjusting the coating amounts thereof to be as follows, and the polyethylene terephthalate support provided with the antistatic layer was subbed with a poly(styrene-butyl acrylate-glycidyl methacrylate) latex on the opposite side of the antistatic layer and the resulting support was coated with the resulting emulsion.

| | |
|---|---|
| Latex polymer: a styrene-butyl acrylate-acrylic acid tricopolymer | 1.0 g/m$^2$ |
| Tetraphenyl phosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 150 mg/m$^2$ |
| Phenidone | 100 mg/m$^2$ |
| A sodium styrenesulfonate-maleic acid polymer (Mw = 250,000) | 150 mg/m$^2$ |
| Butyl gallate | 500 mg/m$^2$ |
| 5-methylbenzotriazole | 30 mg/m$^2$ |
| 2-mercaptobenzimidazole-5-sulfonic acid | 30 mg/m$^2$ |
| Inert ossein gelatin (having an isoelectric point of 4.9) | See Table 1 |
| Amount of silver | 2.8 g/m$^2$ |
| Tetrazolium compound | 50 mg/m$^2$ |

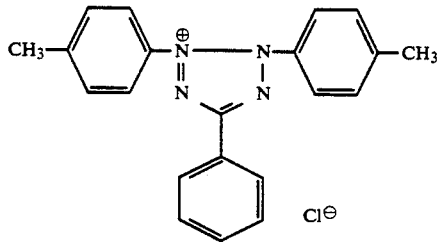

(Emulsion layer-protective layer)

This layer was prepared and then coated so as to be the following coating amount as the emulsion layer-protective layer.

| | |
|---|---|
| Fluorinated dioctylsulfosuccinic acid ester | 3 mg/m$^2$ |
| $C_9F_{17}O—C_6H_4—SO_3Na$ | 2 mg/m$^2$ |
| A matting agent: polymethacrylic acid methyl (having an average particle size of 3.5 μm) | 100 mg/m$^2$ |
| Gelatin | See Table 1 |
| Amorphous silica (having an average particle size of 4.0 μm) | 50 mg/m$^2$ |
| A sodium styrenesulfonate-maleic acid copolymer | 100 mg/m$^2$ |
| Dye | 30 mg/m$^2$ |

-continued

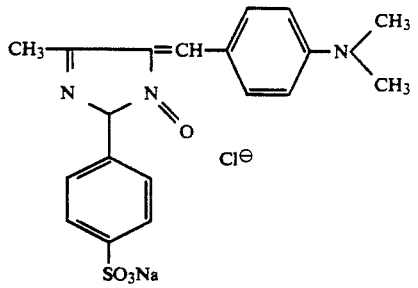

(Backing layer and backing layer-protective layer)

A corona-discharge treatment was applied, at an intensity of 25W/(m$^2$.min), to the support on the side of the antistatic layer coated, that was, the opposite side of the emulsion layer coated. Then, a backing layer containing backing dyes having the following compositions and a backing layer-protective layer were each coated thereon.

| (Backing layer) | |
|---|---|
| Hydroquinone | 50 mg/m$^2$ |
| Phenidone | 10 mg/m$^2$ |
| Latex polymer: a butyl acrylate-styrene copolymer | 500 mg/m$^2$ |
| A styrene-maleic acid copolymer | 100 mg/m$^2$ |
| Citric acid | 40 mg/m$^2$ |
| Benzotriazole | 100 mg/m$^2$ |
| A styrenesulfonic acid-maleic acid copolymer | 100 mg/m$^2$ |
| Lithium nitrate | 30 mg/m$^2$ |
| Backing dyes (a), (b), (c), (d) and (e) | |
| (a) | 40 mg/m$^2$ |

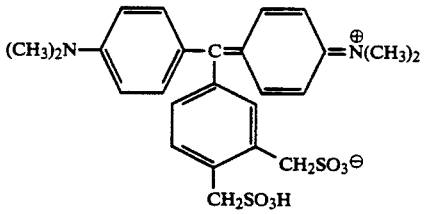

(b) 30 mg/m$^2$

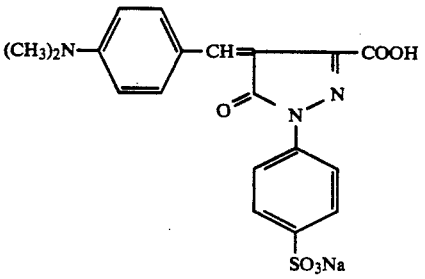

(C) 30 mg/m$^2$

-continued (Backing layer)

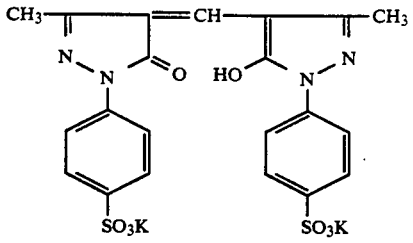

(d) 50 mg/m²

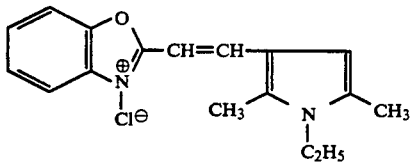

(e) 20 mg/m²

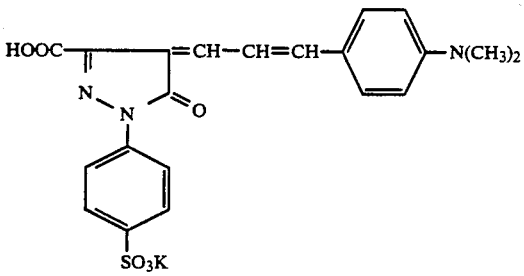

(Backing layer-protective layer)

The following additive was prepared so as to make the following coating amount and was then simultaneously multilayered on a backing layer.

| | |
|---|---|
| Dioctyl sulfosuccinate | 200 mg/m² |
| Matting agent: methyl polymethacrylate (having an average particle size of 4.0 μm) | 50 mg/m² |
| Alkali-treated gelatin (having an isoelectric point of 4.9) | See Table 1 |
| Sodium fluorododecylbenzene sulfonate | 50 mg/m² |

After adding the hardeners shown in Table 1 to the above-mentioned emulsion layer, emulsion-protective layer, backing layer and backing-protective layer, respectively, these layers were each simultaneously multilayered in this order on each of the sides and were then dried up.

The resulting sample was preserved for 3 days at 23° C. and 50%RH and was then separated into two parts. One part thereof was preserved for another 3 days in the same conditions and the other part thereof was sealed in a moisture-proof envelope in the same conditions and was then preserved for 3 days at 55° C. Then, both of the parts were subjected to the torture tests, respectively. Out of the tested samples, one was exposed to light through a step-wedge and the other was unexposed to light. Each of the samples was processed with the following developer and fixer and they were each subjected to the evaluations of the resulting sensitivities and residual colors. The antistatic functions thereof were proved to be satisfactorily effective because the antistatic layer was provided.

Sensitivity: Expressed in terms of an exposed amount capable of providing a density of 0.1 and the sensitivities of each evaluated samples are shown by the relative sensitivities to that of Comparative Sample 1 regarded as a value of 100.

Residual color: Each unexposed and processed subject film was visually evaluated by the following grades.

A = excellent; B = Good; and C = Failure

<Formula of Developer>

| | |
|---|---|
| (Composition A) | |
| Deionized water | 150 ml |
| Disodium ethylenediaminetetraacetate | 2 g |
| Diethylene glycol | 50 mg |
| Potassium sulfite, (in an aqueous 55% W/V solution) | 100 ml |
| Potassium carbonate | 50 g |
| Hydroquinone | 15 g |
| 1-phenyl-5-mercaptotetrazole | 200 mg |
| Potassium bromide | 4.5 g |
| 5-methylbenzotriazole | 200 mg |
| Potassium hydroxide | Amount to make the solution to have pH 10.9 |
| (Composition B) | |
| Deionized water | 3 ml |
| Diethylene glycol | 50 g |
| Disodium ethylene diaminetetraacetate | 25 g |
| Acetic acid (in an aqueous 90% solution) | 0.3 ml |
| 5-nitroindazole | 110 mg |
| 1-phenyl-3-pyrazolidone | 500 mg |

When making use of the developer, the above-given Compositions A and B were dissolved in this order into 500 ml of water, so that the total amount of the resulting developer was made to be 1 liter.

<Formula of Fixer>

| | |
|---|---|
| (Composition A) | |
| Ammonium thiosulfate, (in an aqueous 72.5 w % solution) | 240 ml |
| Sodium sulfite | 9.5 g |
| Sodium acetate.trihydrate | 15.9 g |
| Boric acid | 6.7 g |
| Sodium citrate.dihydrate | 2 g |
| Acetic acid (in an aqueous 90 w % solution) | 8.1 ml |
| Glutaraldehyde | 5 g |
| (Composition B) | |
| Deionized water | 17 ml |
| Sulfuric acid (in an aqueous 50 w % solution) | 5.8 g |
| Aluminium sulfate (in an aqueous solution having a reduced $Al_2O_3$ content of 8.1 w %) | 26.5 g |

When making use of the fixer, the above-given Compositions A and B were dissolved in this order into 500 ml of water, so that the total amount of the resulting developer was made to be 1 liter. The resulting fixer was proved to have a pH of approximately 4.3.

<Conditions of Development Process>

| (Processing step) | (Temperature) | (Time) |
|---|---|---|
| Developing | 34° C. | 15 sec. |
| Fixing | 34° C. | 15 sec. |
| Washing | Ordinary temp. | 10 sec. |
| Drying | 40° C. | 9 sec. |

TABLE 1

| Sample No. | Anti-static layer | Hardener (mg/g Gelatin) Emulsion side: Emulsion Layer Kind | Emulsion Layer Amnt | Protect Layer Kind | Protect Layer Amnt | Backing side: Backing Layer Kind | Backing Layer Amnt | Protect Layer Kind | Protect Layer Amnt | Gelatin (g/m²)* Emulsion side | Backing side | Sensitivity 23° C. | Sensitivity 55° C. | Residual color 23° C. | Residual color 55° C. |
|---|---|---|---|---|---|---|---|---|---|---|---|---|---|---|---|
| 1. | Po | F** | 5 | F | 5 | G** | 5 | G | 5 | 2.7 | 3.0 | 100 | 30 | A | C |
| 2. | M | F | 5 | F | 5 | G | 5 | G | 5 | 2.7 | 3.0 | 100 | 50 | A | C |
| 3. | Po | — | — | I-3 | 100 | — | — | I-3 | 100 | 2.7 | 3.0 | 105 | 85 | A | B |
| 4. | Po | I-3 | 100 | — | — | I-3 | 100 | — | — | 2.7 | 3.0 | 105 | 85 | A | B |
| 5. | Po | I-3 | 50 | I-3 | 50 | I-3 | 50 | I-3 | 50 | 2.7 | 3.0 | 105 | 90 | A | A-B |
| 6. | Po | — | — | I-5 | 120 | — | — | I-5 | 120 | 2.7 | 3.0 | 110 | 95 | A | B |
| 7. | Po | I-5 | 60 | I-5 | 60 | I-5 | 60 | I-5 | 60 | 2.7 | 3.0 | 110 | 100 | A | A-B |
| 8. | M | I-5 | 60 | I-5 | 60 | I-5 | 60 | I-5 | 60 | 2.7 | 3.0 | 110 | 100 | A | A-B |
| 9. | Po | — | — | I-3 | 100 | — | — | I-3 | 100 | 2.3 | 2.4 | 110 | 105 | A | A-B |
| 10. | Po | I-3 | 50 | I-3 | 50 | I-3 | 50 | I-3 | 50 | 2.3 | 2.4 | 110 | 105 | A | A |
| 11. | M | — | — | I-5 | 120 | — | — | I-5 | 120 | 2.3 | 2.4 | 110 | 105 | A | A-B |
| 12. | M | I-5 | 60 | I-5 | 60 | I-5 | 60 | I-5 | 60 | 2.3 | 2.4 | 110 | 105 | A | A-B |
| 13. | M | I-5 | 60 | I-5 | 60 | I-5 | 60 | I-5 | 60 | 2.3 | 2.2 | 110 | 108 | A | A |

*Amount of gelatin on the emulsion side was expressed by the total amount thereof contained in the emulsion layer and emulsion-protective layer, and the amount of gelatin on the backing side was the total amount thereof contained in the backing layer and backing-protective layer.
**F and G represent formalin and glyoxal respectively.

As is obvious from the results shown in Table 1, Samples No. 3 through No. 13 were proved to be substantially few in sensitivity lowering in the torture test and excellent in residual color elimination, as compared to Samples No. 1 and No. 2.

What is claimed is:

1. In a light-sensitive silver halide photographic element comprising a polyester support having a first and second side; and carrying at least one light sensitive silver halide emulsion layer; the improvement wherein an antistatic layer, the light sensitive silver halide emulsion layer and a protective layer are carried on the first side of the support, and a backing layer and a backing protective layer are carried on the second side of the support, and wherein the anti-static layer is composed of either a water soluble electric conductive polymer, hydrophobic polymer latex and a hardener, or metal oxide particles dispersed in gelatin; and the protective layer and the backing protective layer are hardened by a hardener represented by a formula of

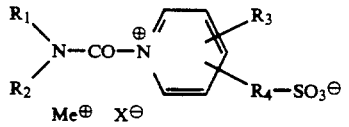

wherein $R_1$ and $R_2$ are each an alkyl group having 1 to 3 carbon atoms, or an atom group necessary to form a piperidine ring or a morpholine ring; $R_3$ is a hydrogen atom; $R_4$ is a methylene group, ethylene group, a propylene group or a simple chemical bond; $Me^+$ is an alkali-metal cation; and $X^-$ represents an anion; and the gelatin amount is less than 2.5 g/m² on each side of the support.

2. The photographic element as claimed in claim 1 wherein $R_1$ and $R_2$ are an atom group necessary to form a piperidine ring or a morpholine ring; $R_3$ is a hydrogen atom; $R_4$ is a methylene group or a propylene group; $Me^+$ is an alkali-metal cation; and $X^-$ represents an anion.

3. The photographic element as claimed in claim 1 wherein the antistatic layer is composed of a water soluble electric conductive polymer, hydrophobic polymer latex and a hardener.

4. The photographic element as claimed in claim 3 wherein the hardener is an epoxy hardener.

5. The photographic element of claim 1 wherein $R_1$ and $R_2$ are each an alkyl group having 1 to 3 carbon atoms.

6. The photographic element of claim 1 wherein the antistatic layer is composed of metal oxide particles dispersed in gelatin.

7. The photographic element of claim 1 wherein $R_4$ is an ethylene group.

8. The photographic element of claim 1 wherein $R_4$ is a methylene group.

9. The photographic element of claim 1 wherein $R_4$ is a propylene group.

10. The photographic element of claim 1 wherein $R_4$ is a simple chemical bond.

11. The photographic element as claimed in claim 1 wherein $R_1$ and $R_2$ are an atom group necessary to form a piperidine ring or a morpholine ring; $R_3$ is a hydrogen atom; $R_4$ is an ethylene group; $Me^+$ is an alkali-metal cation; and $X^-$ represents an anion.

12. The photographic element as claimed in claim 1 wherein $R_1$ and $R_2$ are an atom group necessary to form a piperidine ring or a morpholine ring; $R_3$ is a hydrogen atom; $R_4$ is a simple chemical bond; $Me^+$ is an alkali-metal cation; and $X^-$ represents an anion.

* * * * *